US005197179A

United States Patent [19]

Sendzimir et al.

[11] Patent Number: 5,197,179

[45] Date of Patent: Mar. 30, 1993

[54] MEANS AND A METHOD OF IMPROVING THE QUALITY OF COLD ROLLED STAINLESS STEEL STRIP

[75] Inventors: Michael G. Sendzimir, Woodbury; John W. Turley, Oxford, both of Conn.

[73] Assignee: T. Sendzimir, Inc., Waterbury, Conn.

[21] Appl. No.: 687,321

[22] Filed: Apr. 18, 1991

[51] Int. Cl.[5] ..... B22D 11/126; B23P 23/04

[52] U.S. Cl. ..... 29/527.4; 29/33 C; 29/33 Q; 29/33 S; 29/527.7

[58] Field of Search ..... 29/527.7, 527.4, 33 C, 29/33 Q, 33 S

[56] References Cited

U.S. PATENT DOCUMENTS 4,550,487 11/1985 Hoshiro et al. ..... 29/527.7

FOREIGN PATENT DOCUMENTS 387786 9/1990 European Pat. Off. .

*Primary Examiner*—Carl J. Arbes

*Attorney, Agent, or Firm*—Frost & Jacobs

[57] ABSTRACT

A continuous process line and a method for conversion of hot rolled stainless steel strip to a condition suitable for cold rolling. The process line comprises a conventional hot band annealing and pickling line having annealing and pickling sections, to which a rolling mill is added ahead of the annealing section. The process comprises the steps of cold rolling, annealing and pickling to minimize gauge and hardness variations along the length of the strip and to reduce the thickness of the strip.

12 Claims, 3 Drawing Sheets

MEANS AND A METHOD OF IMPROVING THE QUALITY OF COLD ROLLED STAINLESS STEEL STRIP

TECHNICAL FIELD

The invention relates to the improvement of the quality of stainless steel strip cold rolled without an intermediate anneal, and more particularly to the addition of a mill and the step of rolling the hot band ahead of the annealing section in the process line for annealing and pickling the stainless steel hot band.

BACKGROUND ART

The most widely used procedure for converting hot rolled stainless steel (hot band) into finished cold rolled product suitable for the marketplace consists of the following steps: (1) annealing; (2) pickling; (3) coil build-up (including welding similar coils end-to-end to make a large coil, welding of leader strips "tails," to both ends of the coil, and trimming the edges of the strip); (4) cold breakdown on a reversing rolling mill; (5) intermediate annealing and removal of "tails"; (6) cold finish rolling on a reversing rolling mill; (7) final annealing; and (8) temper rolling.

Unlike carbon steels, which usually undergo little or no work hardening during hot rolling, stainless steel is typically work hardened when it comes from the hot mill, the hardening corresponding to about 10% to 20% cold reduction.

A given plant may not follow the above-described procedure exactly. For example, some plants do not utilize "tails." Also, strip grinding facilities are needed in many cases to repair surface defects in the hot band.

In general, intermediate annealing following a first stage of cold rolling has been required when the total reduction in thickness from hot band to finished product exceeds approximately 70% when Sendzimir 20-high cluster mills are used for cold rolling (even less if 4-high mills are used). This is because the strip work hardens as it is deformed. In recent years, due to the high cost of energy, great efforts have been made to reduce the requirement for intermediate annealing, despite the fact that average finished thickness has been trending downwards. This has been achieved by: (a) ordering hot band as thin as is required to eliminate the need for the intermediate anneal and (b) by taking greater reductions on the strip than 70% before annealing the material. For the most common 18-8 stainless steel alloy (18% chromium, 8% nickel content) total reductions of 80% are quite common and up to 90% are not unheard of.

The result of this is that the typical stainless steel cold mill now rolls over 80% of its product without an intermediate anneal, as compared with perhaps 20%, ten or fifteen years ago.

There are some disadvantages to this approach. First of all, lighter gauge hot band is more expensive. Secondly, the hot band is subject to a greater percentage variation in thickness along its length due to the temperature difference from end-to-end, (the tail end of the coil spending more time from leaving the furnace to being rolled than the nose end, and the thinner the gauge being rolled, the greater the time difference and resulting temperature difference). It should be noted that in hot rolling, the cooler the strip is, the harder it becomes, and the bigger the deflection of the mill structure.

Thirdly, further disadvantages stem from taking total cold reductions as high as 80% or 90%. These include increased problems with edge cracking, more frequent breaks, and more difficulty in producing good strip flatness, these difficulties resulting from the increased hardness and reduced ductility of the strip at high total reductions.

A further disadvantage arises from the elimination of the intermediate anneal, this being that it is much more difficult to obtain high gauge accuracy. This is due directly to the gauge variation in the hot band. Usually, an AGC (automatic gauge control system) is used on the cold mill in order to help the mill "iron out" the gauge variations. The variation in entry gauge causes variation in the roll separating force. This results in a corresponding variation in deformation of the mill structure, which causes a corresponding variation in roll gap, and hence, exit gauge. For example, if the incoming gauge increases, it forces the work rolls further apart (by an amount inversely proportional to the stiffness of the mill structure) and this increases the roll gap, and hence the exit gauge.

The AGC system is used to sense the variation in exit gauge (or in roll gap, or in elongation) and to adjust the mill screw down in order to keep this variation to a minimum. At first sight, it would appear that if a good AGC system is used to "iron out" the gauge variation on the first pass on the reversing mill, it should not be necessary to use the AGC on later passes, because the entry gauge should be uniform on the second pass. Unfortunately, this is not the case because there will be a variation in strip hardness along the length of the strip rolled during the first pass, corresponding to the initial variation in strip thickness. This is because the initially thicker portions of the strip must undergo additional work as compared to other portions, and as a result become more work hardened.

Therefore, if no AGC is used during the second pass, the variations in hardness of the strip coming to the cold mill will cause corresponding variations in roll separating force, mill deflection, roll gap and thus exit gauge. In short, a cold rolling mill can only eliminate gauge variations or hardness variations. It cannot eliminate both.

For these reasons, the AGC must be used on every pass, and the performance of the AGC is limited by the big variation in entry gauge and/or hardness for which it must compensate on every pass. It should be noted here that gauge variations from end-to-end of a hot rolled stainless steel coil of up to 10% are not unusual, and fairly rapid variations in gauge (caused by "skid marks") of 2% or 3% may also occur at several points in the coil. "Skid marks" are portions of the coil which correspond to the parts of the slab which rested on the skids in the reheat furnace, prior to delivery to the hot mill used to convert the slab to hot band, these parts being cooler than the adjacent parts of the slab when they are rolled. Now, when an intermediate anneal is adopted, it is possible to eliminate the hardness variation along the coil. Therefore, if the AGC is used to give reasonable gauge accuracy on the last Pass before the intermediate anneal, then the strip delivered from the intermediate annealing furnace will have the same reasonable gauge accuracy, but will have virtually no hardness variations. Thus, the AGC has very little work to do on the subsequent passes (the finishing passes) on the reversing mill, so that very high levels of performance can be achieved.

By eliminating the intermediate anneal, this mechanism is lost, and there is a resulting degradation in gauge accuracy in the finished Product. This can result in a large cost penalty, because stainless steels are very expensive materials, and a loss in yield of, say, one-half percent, could result in annual revenue loss of millions of dollars for a typical 50" or 60" mill. Note that, if a minimum gauge is specified, and the gauge tolerance achieved is plus or minus 1%, then the average gauge must be set 1% higher than the minimum. On the other hand, if the tolerance achieved is plus or minus one-half percent, then the average gauge needs only to be set one-half per cent higher than the minimum.

One object of the present invention is to counteract this degradation in gauge accuracy caused when the intermediate anneal is eliminated. A further object is to reduce the incoming gauge of strip delivered to the reversing mill so that, for a given hot band thickness and finish strip thickness, the total reduction applied by the cold rolling process can be reduced, thus reducing the incidence of edge cracks and strip breaks. Alternatively, for a given finished strip thickness, the objective is to enable a hot band of greater thickness (and hence of lower cost, and subject to smaller percentage thickness variation) to be used.

DISCLOSURE OF THE INVENTION

According to the invention there is provided a continuous process line and a method for conversion of hot rolled stainless steel strip to a condition suitable for cold rolling. The continuous process line comprises an uncoiler for hot rolled stainless steel coils, a shear to cut the coil ends to prepare them for welding, a welder to join the ends of successive coils, an entry storage loop to provide strip to the annealing section when the paid off is stopped to allow loading of a new coil and welding of its nose to the tail of the previous coil, an annealing section to soften the strip, a pickling section to remove impurities from and to clean the strip, an exit storage loop to draw material from the pickling section when the exit shear operates at the completion of rewinding a coil and during removal of a coil prior to feeding the nose end of the next coil to the rewinder, an exit shear and a rewinder.

To such a line, present invention adds the assembly of a first set of bridle rolls to increase tension of the strip to a level suitable for rolling, a rolling mill to reduce the thickness of the strip and even out gauge variations in the strip, wiper means to remove oil from the strip surface, and a second set of bridle rolls to reduce tension of the strip to a level suitable for annealing. In one embodiment, this assembly is located immediately ahead of the entry storage loop. In a second embodiment, this assembly is located immediately following the entry storage loop.

In either embodiment of the invention the rolling mill comprises a four-high mill, a six-high mill, or preferably a side supported six-high mill.

The above described process line enables a continuous process comprising the steps of cold rolling, annealing and pickling the hot rolled stainless steel strip, minimizing both gauge and hardness variations along the length of the strip and reducing the strip thickness.

DETAILED DESCRIPTION OF THE INVENTION

Figure 1:
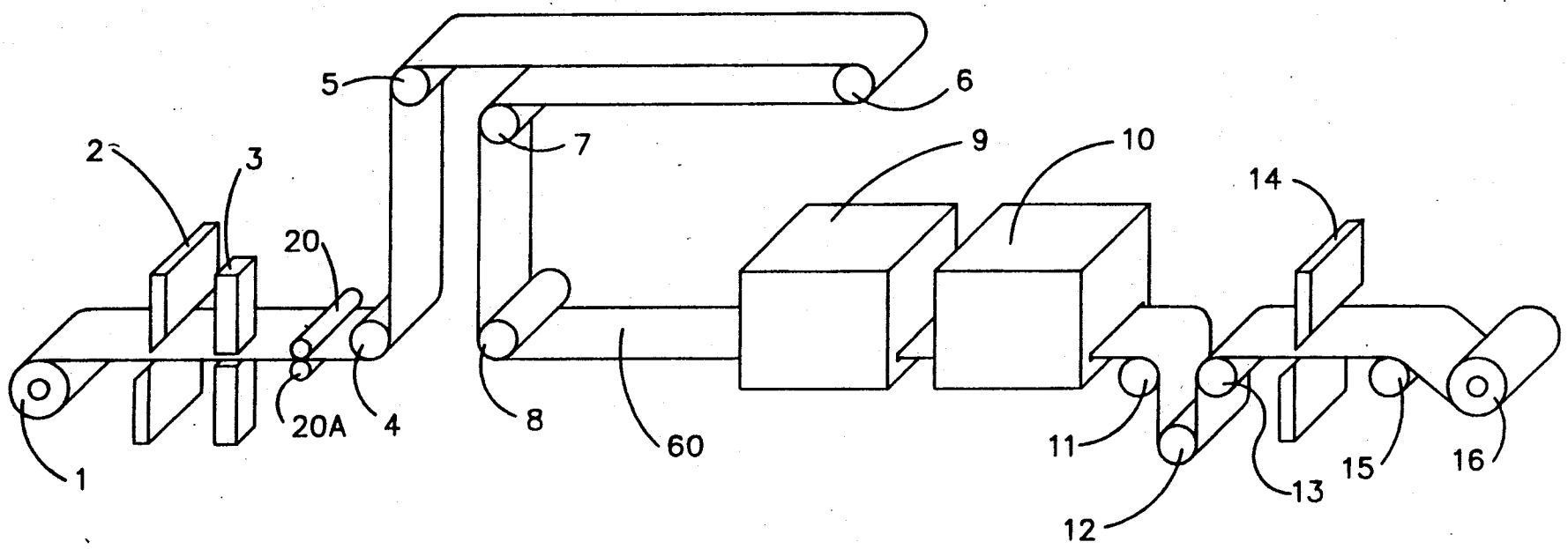
FIG. 1 (PRIOR ART)
FIG. 1 is semi-diagrammatic isometric view of a typical prior art process line for annealing and pickling of stainless steel hot bands.

FIG. 1 is a semi-diagrammatic representation of a typical prior art process line for annealing and pickling of stainless hot bands. It should be understood that such a line is much more complex than is indicated. For example, the furnace section generally consists of heating zones, holding and cooling zones, and the pickle section generally consists of several tanks containing pickling chemicals, together with washing and drying equipment to remove the chemicals. The line may also include non-chemical processes such as shot blasting.

However, the main elements of such a line include a payoff, or uncoiler 1, on which the hot rolled stainless steel coils are loaded, and from which they are uncoiled; a shear 2 to cut the coil ends to prepare them for welding; a welder 3 to join the ends of successive coils; a pair of pinch rolls 20 and 20*a* to position the rearward end of a coil ready for shearing it and welding it to the nose of the next coil using the shear 2 and welder 3; an entry storage loop consisting of fixed rollers 4, 5, 7 and 8 and a movable roller 6 used to provide strip to the annealing section 9 when the payoff is stopped to allow loading of a new coil and welding of its nose to the tail of the previous coil; an annealing section 9 consisting of heating and cooling devices used to soften or anneal the strip; a pickling section 10 comprising tanks of chemicals used to remove impurities from the strip surface and washing equipment to clean the strip; an exit storage loop 12 to draw material from the pickle section when the exit shear 14 operates at completion of rewinding a coil, and during the time the coil is removed prior to feeding the nose end of the next coil to the rewinder; an exit shear 14; and a rewinder 16. Pass line rollers 11, 13 and 15 are used to define the path of the strip.

Figure 2:
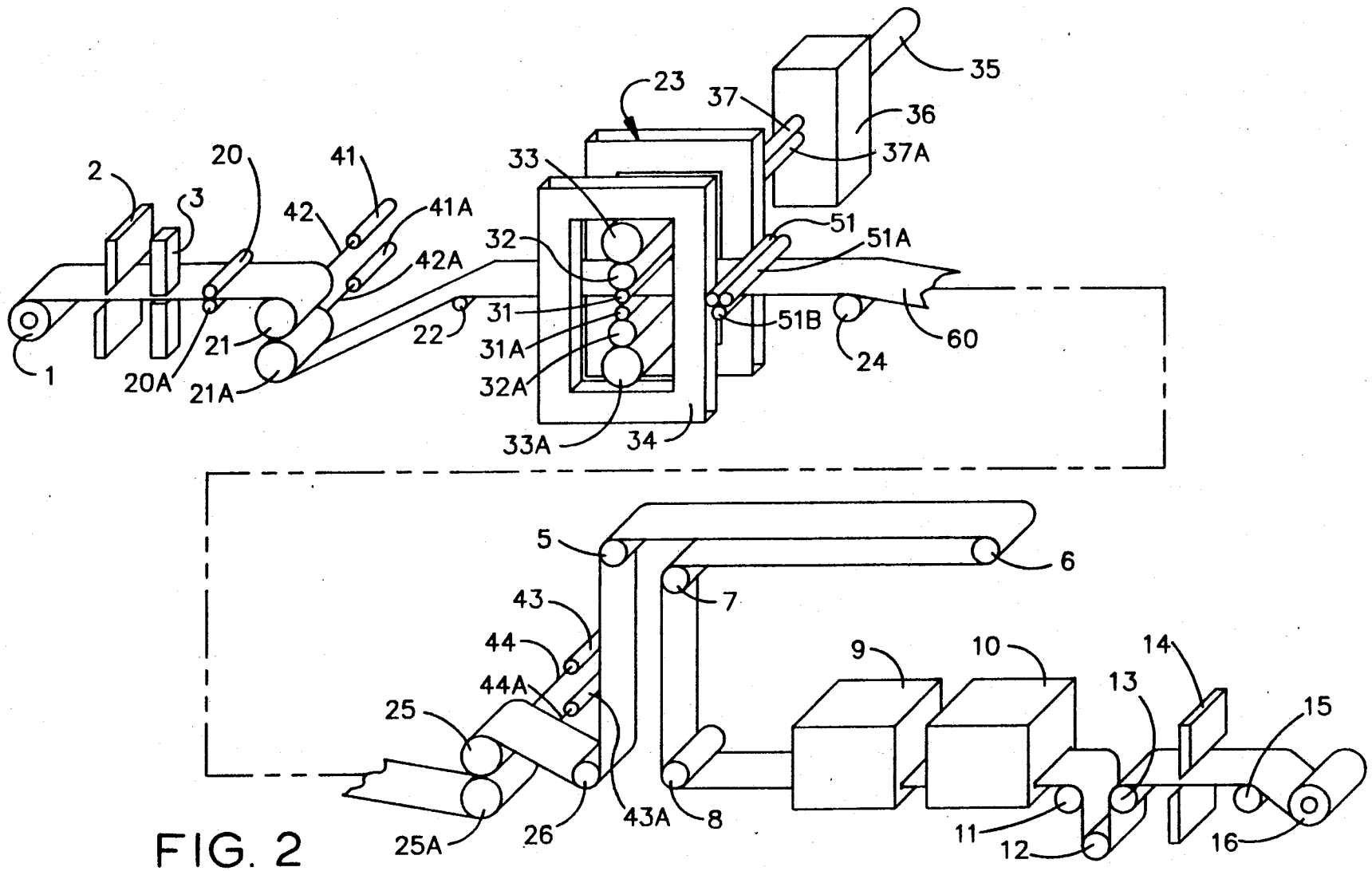
FIG. 2 is a semi-diagrammatic isometric view of an annealing and pickling line for hot rolled stainless steel as modified according to one embodiment of the present invention.

FIG. 2 is a semi-diagrammatic representation of a typical annealing and pickling line for hot rolled stainless steel, as modified according to one embodiment of the present invention. It will be noted that a rolling mill is added to the line in a preferred position between the uncoiler and the storage loop. At this location, the strip is stopped whenever the welder is in operation. In the meantime, the storage loop supplies strip 60 to the furnace and pickle tanks, it being noted that the strip must not be allowed to spend too much time in the furnace or pickle tanks, or it will be damaged.

The line of FIG. 2 is similar to that of FIG. 1 and like parts have been given like index numerals. In FIG. 2, a 6-high cold rolling mill 23 is installed in the line at a location between welder 3 and the entry storage loop. The mill 23 may be, for example, of the type taught in U.S. Pat. Nos. 4,270,377 and 4,531,394. Briefly, the mill comprises a pair of work rolls 31 and 31*a*, a pair of intermediate rolls 32 and 32*a*, and a pair of back-up rolls 33 and 33*a*. The mill may also incorporate side support rolls (not shown) to provide lateral support for the work rolls. The back-up rolls are chock mounted within housing frames 34 and 34*a* and the intermediate rolls are driven by electric motor 35, via pinion stand 36 and drive spindles 37 and 37*a*. The line also includes a tension bridle consisting of two or more bridle rolls 21 and 21*a* at the entry side of mill 23, and a tension bridle consisting of two or more bridle rolls 25 and 25*a* at the exit side of mill 23. Bridle rolls 21 and 21*a* are driven (or braked) by electric motors (drag generators) 41 and 41*a* via spindles 42 and 42*a*. The bridle rolls 25 and 25*a* are driven by electric motors 43 and 43*a* via spindles 44 and 44*a*. The pinch rolls 20 and 20*a* are located at the entry to bridle rolls 21 and 21*a*, and pass line rollers 22 and 24 are used to define the travel path of the strip 60 through the mill. The roller 26 at the exit side of bridle rolls 25 and 25*a* serves the same purpose as roller 4 of FIG. 1 defining the path of the strip 60 up to entry storage loop roller 5, and additionally maximizes the wrap angle of the strip 60 around upper bridle roller 25. Wiper rollers 51*a* and 51*b* are used to remove excess oil from the strip 60.

When the strip 60 is stopped, the mill work rolls 31 and 31*a* can be changed with minimum risk of surface damage to the rolls or strip. Furthermore, the strip 60 can be stopped for an extra few seconds just after the weld passes through the roll bite, allowing time for the mill settings to be changed if the strip thickness, width or alloy changes at the weld, before proceeding with rolling of the next coil. This arrangement also allows the strip 60 to be cleared from the roll gap for a short time to enable the mill 23 to be leveled after a roll change. The mill 23, the uncoiler 1 and the tension bridles 21–21*a* and 25–25*a* at the mill entry and exit would then be accelerated to a speed above line speed in order to refill the entry storage loop.

Figure 3:
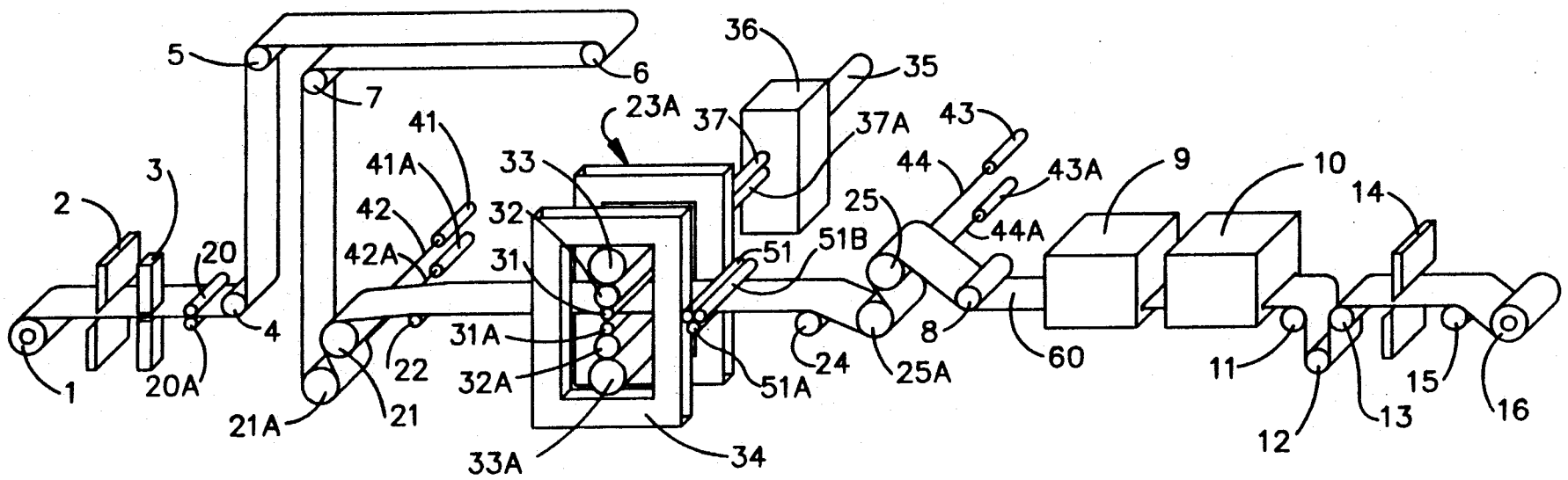
FIG. 3 is a semi-diagrammatic isometric view of an annealing and pickling line for hot rolled stainless steel as modified according to another embodiment of the present invention.

If there are space limitations, in a retrofit application, for example, it is also possible to locate the mill 23 between the entry storage loop and the annealing section 9, as shown in the embodiment of FIG. 3. In the embodiment of FIG. 3, the basic line elements are the same as in the line illustrated in FIG. 1, and like parts have been given like index numerals. In FIG. 3, the side supported 6-high cold rolling mill (designated 23*a*), together with pass line rollers 24 and 8 and bridle rolls 21–21*a* and 25–25*a* are located between the entry storage loop and the annealing section 9. The strip passes from the fixed roller 7 of the entry storage loop down to the lower bridle roll 21*a*, passing about bridle rolls 21*a* and 21. From the bridle rolls 21 and 21*a* the strip passes through the mill 23*a*, between the excess oil removing rolls 51 and 51*a*, over the fixed roll 24 and about the bridle rolls 25*a* and 25. From the bridle roll 25, the strip 60 passes beneath the fixed roll 8 to the furnace section 9. The remainder of the line of FIG. 3 is identical to that of FIG. 1.

In the operation of the mill 23 in the embodiment of FIG. 2 and the mill 23*a* in the embodiment of FIG. 3 there are certain common requirements. First of all, it is very important that the strip tracks truly down the middle of the line, i.e., the strip centerline is coincident with the line centerline. Therefore, great care must be taken to insure that the mill 23 or 23*a* is properly leveled.

The normal method of leveling a rolling mill is to screwdown on both the drive and operator sides of the mill until a certain separating force level is reached, with the work rolls touching each other (i.e., no strip in the mill). Thereafter, further screwdown is performed on the drive side or the operator side of the mill until the same separating force is achieved on the drive and operator sides. Unfortunately, in the embodiment of FIG. 3, this normal method of leveling a rolling mill cannot be adopted because the strip is always passing through the mill, and the work rolls cannot be brought into contact with each other.

As a result, in the embodiment of FIG. 3, strip tracking sensors to sense if the strip leaving the mill is in line with the strip entering the mill must be included, and a closed loop steering control which can tilt the mill (using differential drive and operator side screwdown) to correct any mis-tracking of the strip must be installed. Strip tracking sensors should include both lateral position sensors and differential tension sensors to check if the strip tension is equal on both sides of the strip. Even in the case of the embodiment of FIG. 2, where mill leveling is easier, such sensors and strip tracking system should be adopted.

Furthermore, to insure that reasonably flat strip is produced, it is necessary to incorporate both entry and exit bridles, in order to apply backward and forward tension respectively.

Finally, because the roll bite must be lubricated, and it may not be possible to remove all traces of oil on the surface of the strip leaving the mill by wiping, the exit bridle rolls must be covered with a material providing a high friction coefficient against oily strip.

While the above-noted requirements apply to both the embodiment of FIG. 2 and the embodiment of FIG. 3, the embodiment of FIG. 3 is characterized by certain additional requirements. For example, the strip must move through the mill at all times. Thus, if any rolling problems develop, it must be possible to open the rolls wide enough to clear the strip completely, giving it an unobstructed path through the mill. In the embodiment of FIG. 3, it must be possible to change all the mill rolls with the strip passing through the mill. Furthermore, when a weld passes through the mill, it must be possible to open the mill, reset the mill settings, and close the mill during the shortest time interval (to minimize off-gauge material at the coil ends).

In the embodiment of FIG. 3, to avoid skidding of the work rolls on the strip surface, which would cause marking of both the rolls and the strip, it is necessary to continue to drive all the mill rolls at the same speed as the strip, whenever the rolls are open, and are about to be closed on the strip. Finally, in the embodiment of FIG. 3 it must be possible to change work rolls (and also intermediate rolls of the 6-high mill) during passage of a single coil. Depending upon the coil size and the line speed, this usually implies an allowable roll change time of approximately 20 minutes.

In the practice of the present invention, the preferred rolling mill embodiment is the side-supported 6-high mill known as the Z-high mill, described in the above-mentioned U.S. Pat. Nos. 4,270,377 and 4,531,394, and incorporated herein by reference. A study comparing the theoretical performance of a 4-high mill and a side-supported 6-high mill, utilizing the same mill housings and backup rolls and bearings, for a mill rolling up to 60" wide 24 inch to 0.08 inch stainless steel strip, lead to the following conclusions. At all widths above approximately 40", and at all gauges from 0.24 inch to 0.08 inch the 4-high mill reductions were limited by roll separating force. It was possible to achieve a reduction of 25% only for the 0.08 inch thick material in softer grades. When converted to side-supported 6-high operation, the mill was capable of taking approximately 25% to 60% higher reductions than the 4-high mill (depending upon grade and width). The reductions were limited by roll separating force for the harder grades and lighter gauges. Otherwise, they were limited by mill drive torque. It was possible to achieve up to 20% reduction (depending on width) at 0.24 inch starting gauge, increasing to the target 25% reduction at 0.12 inch and below. While a much larger 4-high mill (or non-supported 6-high mill) could be used, such a mill would be much more expensive, and it is doubtful if the performance level would approach that of the side supported 6-high mill.

There are many existing unused 4-high mills available in the world today, and converting such a mill to a side-supported 6-high mill and installing it to obtain an arrangement according to the present invention would provide an economical solution. Converting an existing 4-high mill to a side-supported 6-high mill enables the strip width to be increased substantially without requiring capital investment for new housings, back-up roll chocks and back-up bearings. Furthermore, the reduced work roll diameter of the side-support 6-high mill enables the maximum pass reductions to be achieved at even the increased strip width without exceeding load capacity of the bearings, chocks or mill housings.

The advantage of maximizing the reductions on the rolling mill is that the annealed and pickled strip leaving the line and being delivered to the cold mill is of lighter gauge. This enables the cold reversing mill to roll to a proportionately lighter finished gauge without requiring an intermediate anneal and, for a given finished gauge, may reduce the number of passes required on the cold reversing mill. Furthermore, that portion of the cold mill's production which previously required only one pass (an inefficient process on a reversing mill because handling time is very high relative to rolling time in such a case) can be shipped directly from the rolling anneal and pickle line since the required gauge is achieved by the mill in this line.

What is claimed is:

1. A method of converting hot rolled stainless steel strip to a condition suitable for subsequent cold rolling to final gauge comprising in one continuous line the steps of cold rolling to reduce the thickness of said strip, annealing said reduced thickness strip, and pickling said annealed strip.

2. The method claimed in claim 1 including the step of providing in said line a 4-high mill for said cold rolling.

3. The method claimed in claim 1 including the step of providing in said line a 6-high mill for said cold rolling.

4. The method claimed in claim 1 including the step of providing a side-supported 6-high mill for said cold rolling.

5. A continuous process line for the conversion of hot rolled stainless strip to a condition suitable for subsequent cold rolling to final gauge comprising a rolling mill to reduce the thickness of said hot rolled stainless steel, an annealing section to anneal said reduced thickness strip from said rolling mill and a pickling section to pickle said annealed strip from said annealing section.

6. The continuous process line claimed in claim 5 including a first set of bridle rolls ahead of rolling mill to increase tension in said strip to a level suitable for rolling, a set of wiper rolls following said rolling mill to remove oil from the surface of said strip, and a second set of bridle rolls following said wiper rolls to reduce tension in said strip to a level suitable for annealing in said annealing section.

7. The continuous process line claimed in claim 5 wherein said rolling mill is chosen from the class consisting of a 4-high mill, a 6-high mill and a side-supported 6-high mill.

8. The continuous process line claimed in claim 6 wherein said rolling mill is chosen from the class consisting of a 4-high mill, a 6-high mill and a side-supported 6-high mill.

9. A continuous process line for the conversion of hot rolled stainless steel strip to a condition suitable for subsequent cold rolling to final gauge, said line having an entry end and an exit end, said line including in order, from entry end to exit end, an uncoiler, a shear, a welder, a first set of bridle rolls to increase tension in said strip to a level suitable for rolling, a cold rolling mill to reduce the thickness of said strip to even out gauge variations in said strip, a set of wiper rolls to remove oil from the surface of said strip, a second set of bridle rolls to reduce tension in said strip to a level suitable for annealing, an entry storage loop, an annealing section, a pickling section, an exit storage loop, an exit shear, and a recoiler.

10. The continuous process line claimed in claim 9 wherein said rolling mill is chosen from the class consisting of a 4-high mill, a 6-high mill and a side-supported 6-high mill.

11. A continuous process line, for the conversion of hot rolled stainless steel strip to a condition suitable for subsequent cold rolling to final gauge, said line having an entry end and an exit end, said line including in order, from said entry end to said exit end, a uncoiler, a shear, a welder, an entry storage loop, a first set of bridle rolls to increase tension in said strip to a level suitable for rolling, a cold rolling mill to reduce the thickness of said strip and to even out gauge variations in said strip, wiper means to remove oil from the surface of said strip, a second set of bridle rolls to reduce tension in said strip to a level suitable for annealing, an annealing section, a pickling section, an exit storage loop, an exit shear, and a recoiler.

12. The continuous process line claimed in claim 11 wherein said rolling mill is chosen from the class consisting of a 4-high mill, a 6-high mill and a side-supported 6-high mill.

* * * * *